US009204213B2

(12) United States Patent
Liu

(10) Patent No.: US 9,204,213 B2
(45) Date of Patent: Dec. 1, 2015

(54) MICROPHONE WATERPROOF STRUCTURE

(71) Applicant: CHANFUL VOICE TECHNIC CO., LTD., Taichung (TW)

(72) Inventor: Chun-Lung Liu, Taichung (TW)

(73) Assignee: CHANFUL VOICE TECHNIC CO., LTD., Taichung (TW)

( * ) Notice: Subject to any disclaimer, the term of this patent is extended or adjusted under 35 U.S.C. 154(b) by 132 days.

(21) Appl. No.: 14/220,352

(22) Filed: Mar. 20, 2014

(65) Prior Publication Data

US 2015/0245134 A1 Aug. 27, 2015

(30) Foreign Application Priority Data

Feb. 21, 2014 (TW) ..... 103105962 A

(51) Int. Cl.
*H04R 1/44* (2006.01)
*H04R 1/08* (2006.01)

(52) U.S. Cl.
CPC ... *H04R 1/44* (2013.01); *H04R 1/08* (2013.01)

(58) Field of Classification Search
CPC ..... H01H 2223/003
See application file for complete search history.

(56) References Cited

U.S. PATENT DOCUMENTS 5,940,153 A * 8/1999 Castaneda ..... G02F 1/133308 349/58
2010/0054515 A1* 3/2010 Donauer ..... H04R 1/08 381/355

FOREIGN PATENT DOCUMENTS

CN 202424976 U * 9/2012

OTHER PUBLICATIONS

English machine translation of CN 202424976 (Wu, Yongshen; Novel Remote Control Microphone; published Sep. 2012).*

* cited by examiner

*Primary Examiner* — Wayne Young
*Assistant Examiner* — Mark Fischer
(74) *Attorney, Agent, or Firm* — Guice Patents PLLC

(57) ABSTRACT

A microphone waterproof structure includes: a hollow handle, a window being formed on a top face of the handle; a circuit board having at least one pushbutton and a display screen, the circuit board being mounted in the handle with the pushbutton and the display screen aligned with the window; a sealing member formed with a hollow section and a raised button, the sealing member being disposed at the window with the hollow section aligned with the display screen and the raised button aligned with the pushbutton for pressing the pushbutton; and a transparent cover board disposed at the window of the handle in contact with the sealing member. The raised button of the sealing member protrudes from a buttonhole of the cover board. The microphone has better waterproof effect.

19 Claims, 11 Drawing Sheets

MICROPHONE WATERPROOF STRUCTURE

BACKGROUND OF THE INVENTION

1. Field of the Invention

The present invention relates generally to a microphone, and more particularly to a microphone with waterproof effect.

2. Description of the Related Art

A microphone is used to convert sound into electronic signals. Many electronic components are arranged in the microphone. The microphone can be used indoors and outdoors in various weather conditions and environments. In order to minimize the possibility of damage of the electronic components, the microphone is generally equipped with a waterproof design.

The conventional microphone generally has a gasket and an O-ring mounted on the handle of the microphone to achieve waterproof effect. However, such design can only provide limited waterproof effect. Therefore, the waterproof effect for the microphone is insufficient. Especially, the pushbutton of the microphone has no waterproof design.

Moreover, in many use situations, multiple microphones are used at the same time. The respective users speak by different volumes. Therefore, a sound control person needs to identify different microphones so as to properly adjust the volumes of the microphones according to the speaking volumes of different users. Conventionally, the outer surface of the microphone is designed with a specific color for a sound control person to identify. However, such design is not so distinguishable. The user's hand is likely to shade the microphone to make it difficult for the sound control person to identify the respective microphones, especially from a remote place or in a dark site. In addition, the component of the conventional microphone for color identification is uneasy to replace. Therefore, it is hard to vary the color of the microphone for identification.

SUMMARY OF THE INVENTION

It is therefore a primary object of the present invention to provide a microphone waterproof structure. The circumference of the handle of the microphone and the rear end of the handle are provided with waterproof design to enhance waterproof effect of the microphone.

It is a further object of the present invention to provide a microphone in which the identification color of the microphone can be more easily replaced.

The microphone of the present invention includes:

a hollow handle having an internal receiving space, a window being formed on a top face of the handle;

a circuit board having at least one pushbutton and a display screen, the circuit board being mounted in the handle with the pushbutton and the display screen aligned with the window;

a sealing member, which is a leakproof member, the sealing member being formed with a hollow section and a raised button, the sealing member being disposed at the window with the hollow section aligned with the display screen and the raised button aligned with the pushbutton, whereby when the raised button is pressed, the pushbutton is activated;

a transparent cover board, a buttonhole being formed on a body section of the cover board, the cover board being disposed at the window of the handle in contact with the sealing member, the raised button of the sealing member protruding from the buttonhole for a user to press; and a pickup head positioned at a front end of the handle and electrically connected to the circuit board.

According to the above arrangement, the sections of the circumference of the handle where the pushbuttons are arranged and the bottom end of the handle where the antenna is disposed are all provided with waterproof designs to enhance the waterproof effect of the microphone and prevent the microphone from being damped.

Preferably, the microphone further includes an identification member made of flexible material. A front end of the identification member is sealedly connected with the rear end of the handle. An antenna is disposed at the rear end of the handle and received in the identification member.

Preferably, in the above microphone, the identification member is detachably connected with the rear end of the handle, whereby the identification member can be easily replaced. The identification member is for a user to identify the microphone. Different identification members with different colors can be replaced with each other for a user to identify the microphones.

The present invention can be best understood through the following description and accompanying drawings, wherein:

DETAILED DESCRIPTION OF THE PREFERRED EMBODIMENTS

Figure 1:
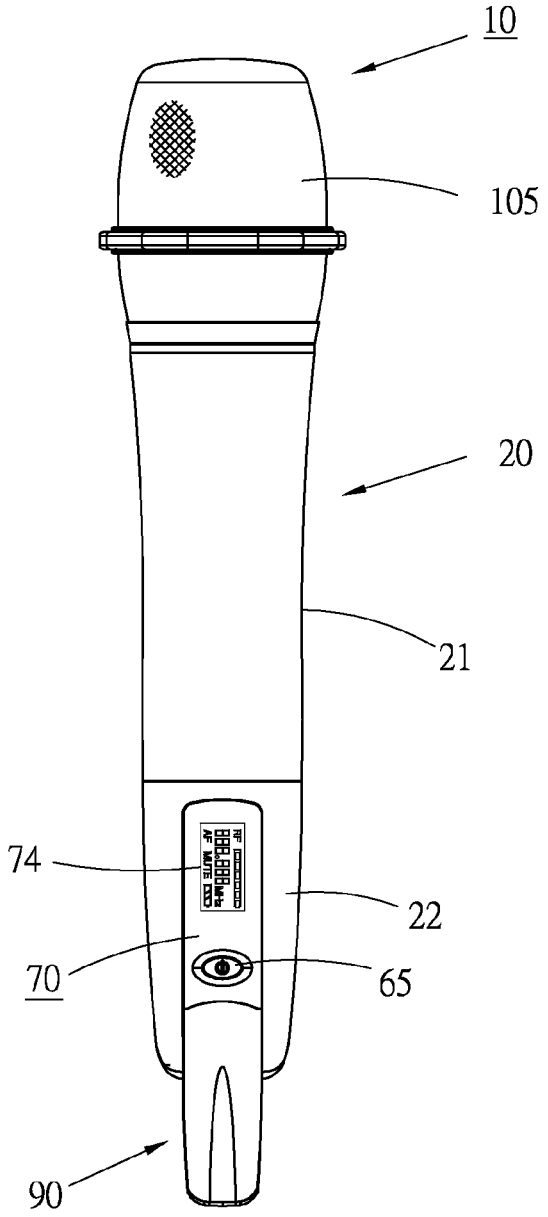
FIG. 1 is a perspective view of a preferred embodiment of the microphone of the present invention.
Figure 2:
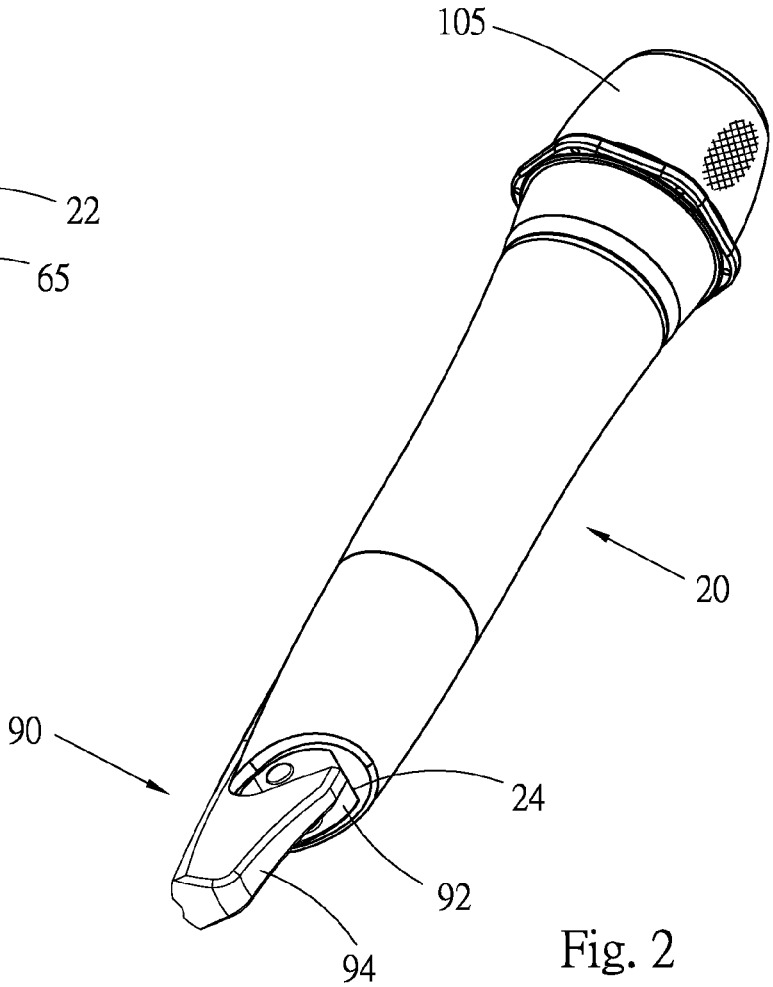
FIG. 2 is a bottom perspective view according to FIG. 1.
Figure 3:
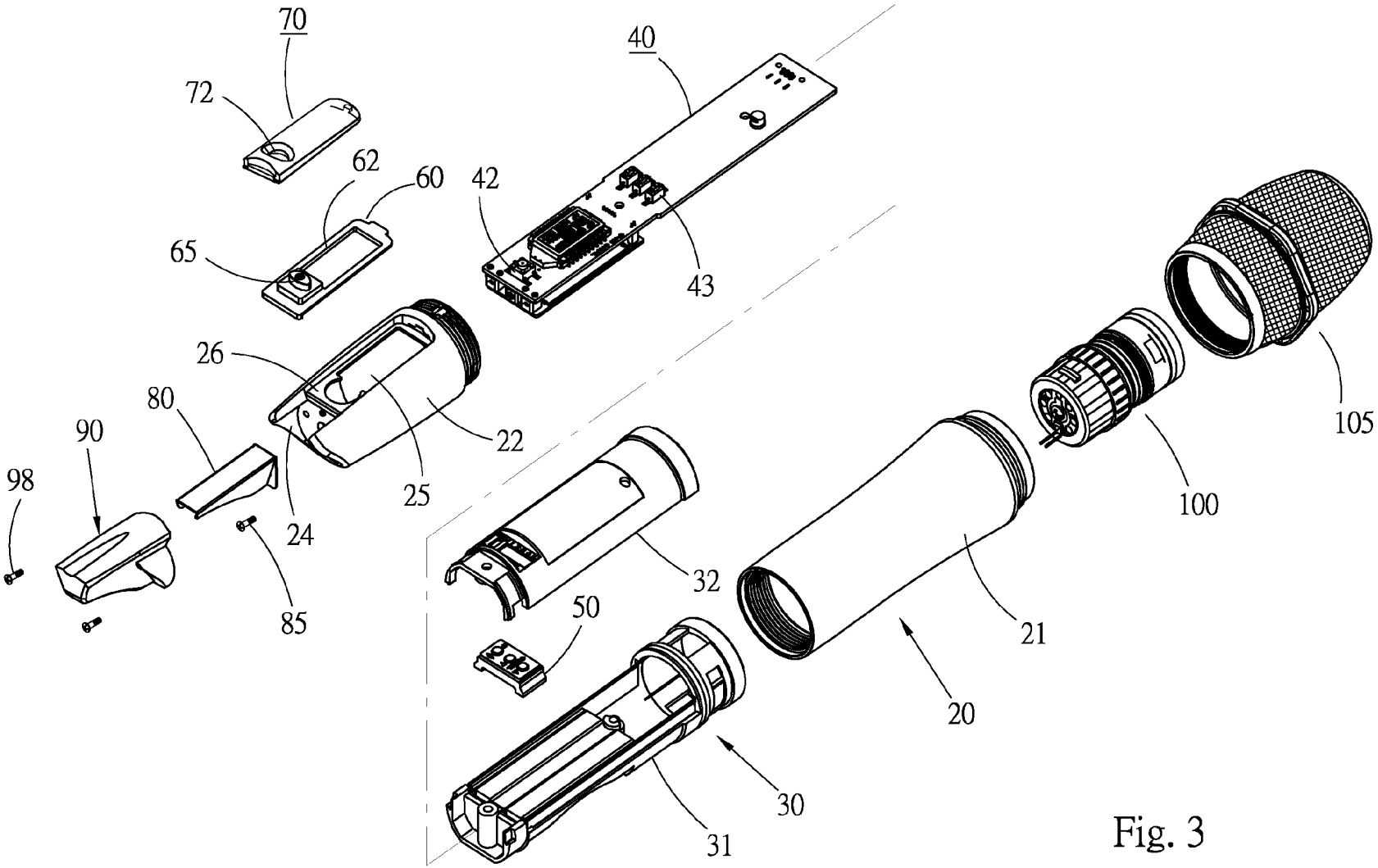
FIG. 3 is a perspective exploded view according to FIG. 1.

Please refer to FIGS. 1 to 3. According to a preferred embodiment, the microphone 10 of the present invention includes a handle 20, a support 30 mounted in the handle, a circuit board 40, several sealing components disposed in the handle and an identification member 90. In this embodiment, a wireless microphone is taken as an example. The wireless microphone has an antenna 80 for transmitting signals. The identification member also serves as a protection sheath for the antenna.

Figure 4:
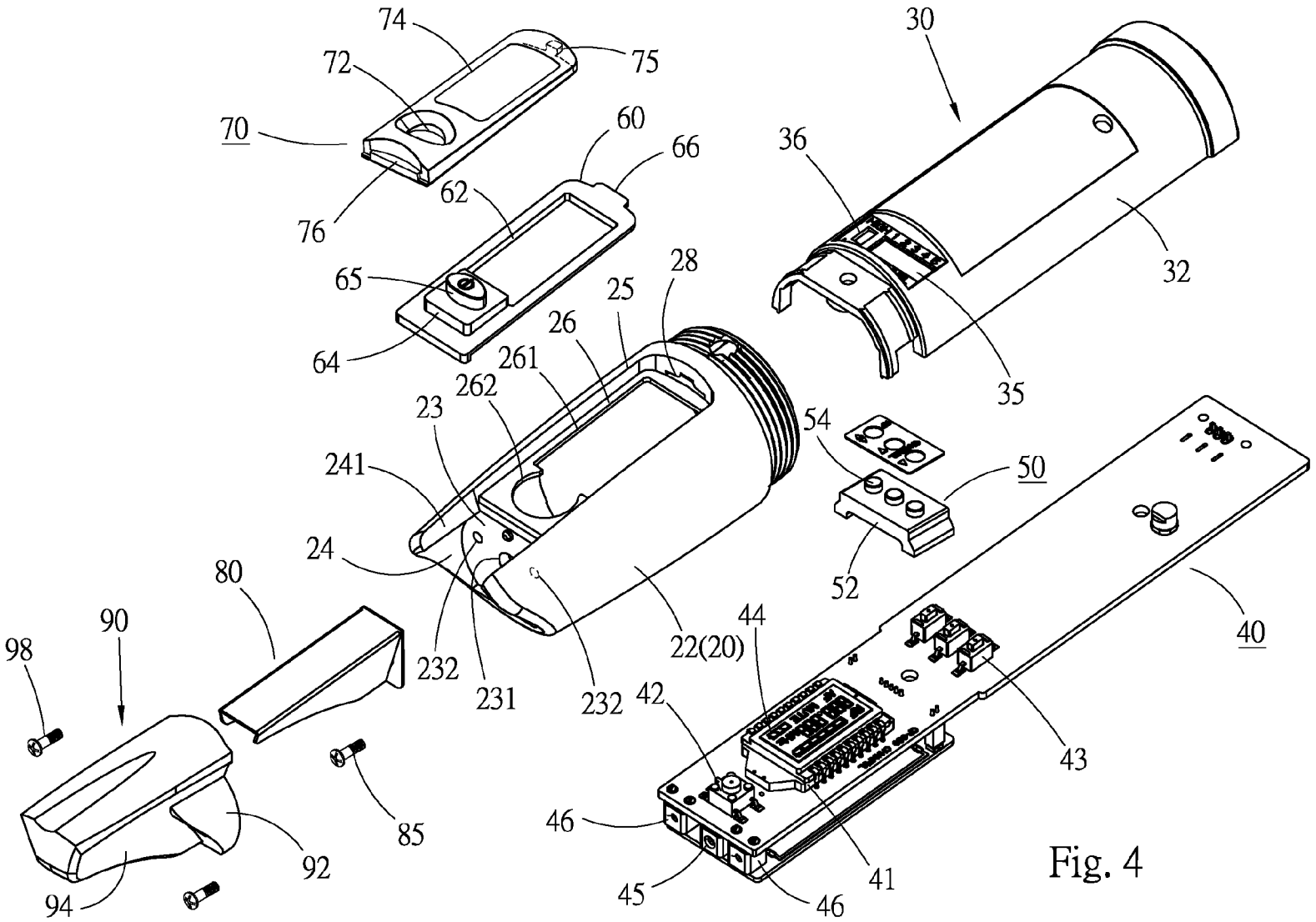
FIG. 4 is a perspective exploded view of some parts of FIG. 3.
Figure 5:
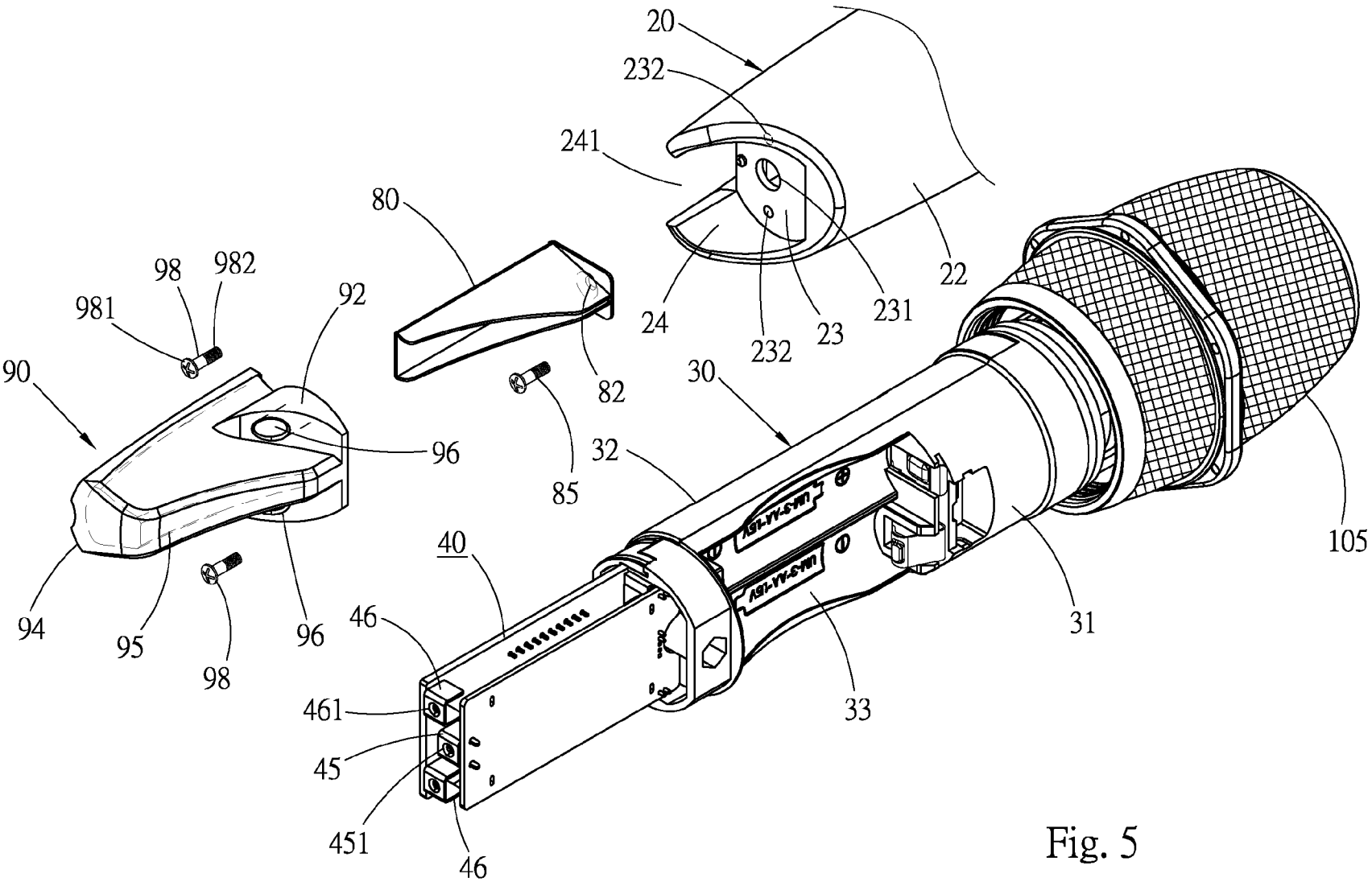
FIG. 5 is a perspective exploded view of some parts of the preferred embodiment of the microphone of the present invention.

The handle 20 is a hollow tubular body having an internal receiving space. The handle is composed of a front sleeve 21 and a rear sleeve 22 screwed with the front sleeve 21. An O-ring is disposed at a junction between the front and rear sleeves 21, 22 to provide airtight effect. As shown in FIGS. 4 and 5, a cavity 24 is formed at a rear end of the handle 20. The handle 20 has a bottom wall 23 separating the receiving space and the cavity 24. The bottom wall 23 is formed with three holes 231, 232, which can be through holes or threaded holes.

Please also refer to FIG. 4. A top face of the rear sleeve 22 is formed with a rectangular window 25. A rear end of the window 25 communicates with the cavity 24. A rectangular inward extending flange section 26 is formed along a periphery of the window 25. The flange section 26 is lower than a top edge of the window 25. With the flange section 26, the window 25 still has a considerably large hollow area. An engagement section 28, which is a socket in this embodiment, is disposed on a wall face of the window 25. A top wall of the cavity 25 is formed with a notch 241 in communication with the rear end of the window 25.

The support 30 is a hollow elongated support body having a main support 31 and a subsidiary support 32, which are detachably mated with each other. In mated state, the main support 31 and the subsidiary support 32 are secured by screws. One side of the support is recessed to form a battery seat 33 for mounting cells or rechargeable batteries therein. At least one perforation, for example, two perforations 35, 36, is formed on the circumference of the support 30 as shown in FIG. 4. The support 30 is mounted and located in the receiving space of the handle 20.

The circuit board 40 has a printed circuit and is equipped with, but not limited to, an integrated circuit 41, several electronic components, at least one pushbutton such as an on-off switch 42, a frequency adjustment module having at least one frequency adjustment switch 43 (three in this embodiment), a radio module, a volume adjustment switch, at least one LED element and a liquid crystal display screen 44. The above electronic components are all electrically connected to the circuit device of the circuit board. The circuit device at least includes a pickup unit, a wireless transmission unit, a light-emitting unit and a charging unit for receiving sonic wave, transmitting radio signals, urging the LED element to emit light and charging the batteries. When pressing the frequency adjustment switch 43, the frequency of the microphone can be adjusted. The volume of the microphone can be adjusted by means of the volume adjustment switch. The frequency of the microphone can be also adjusted/changed by means of wireless frequency coupling.

Figure 6:
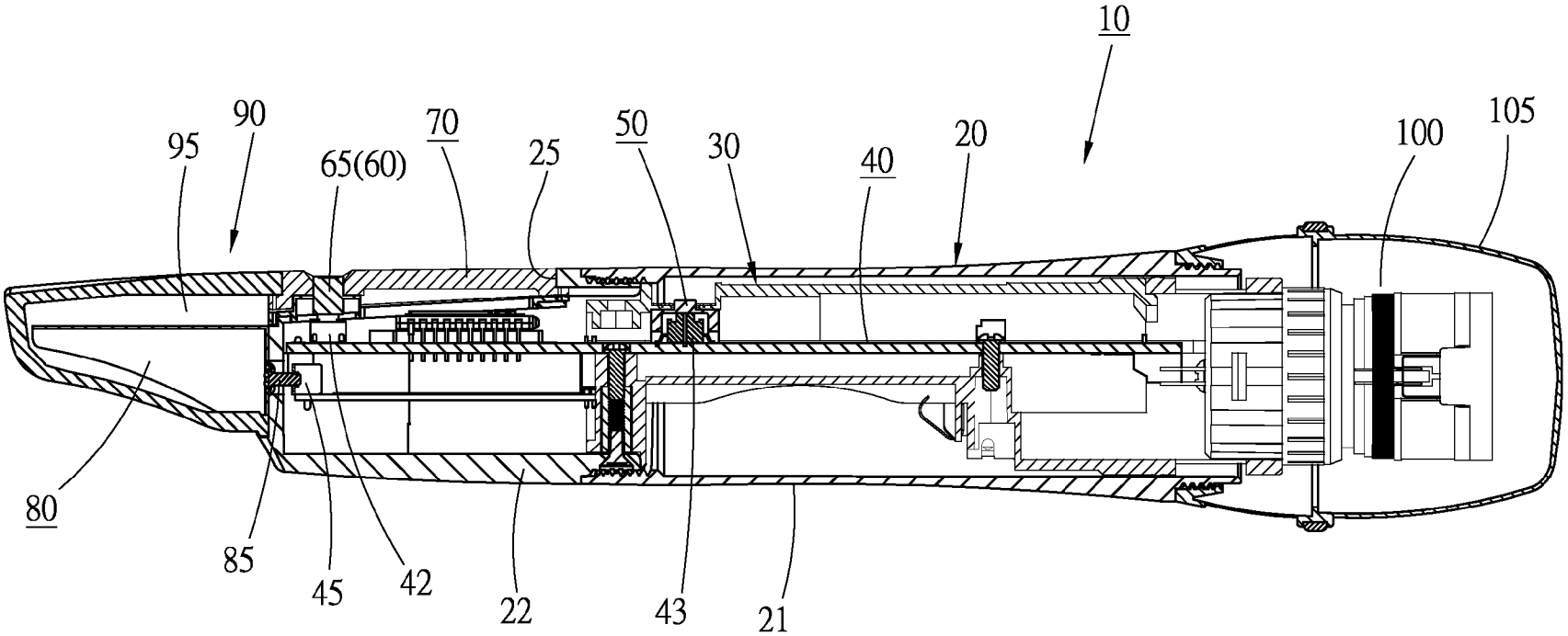
FIG. 6 is a longitudinal sectional view of the preferred embodiment of the microphone of the present invention.
Figure 7:
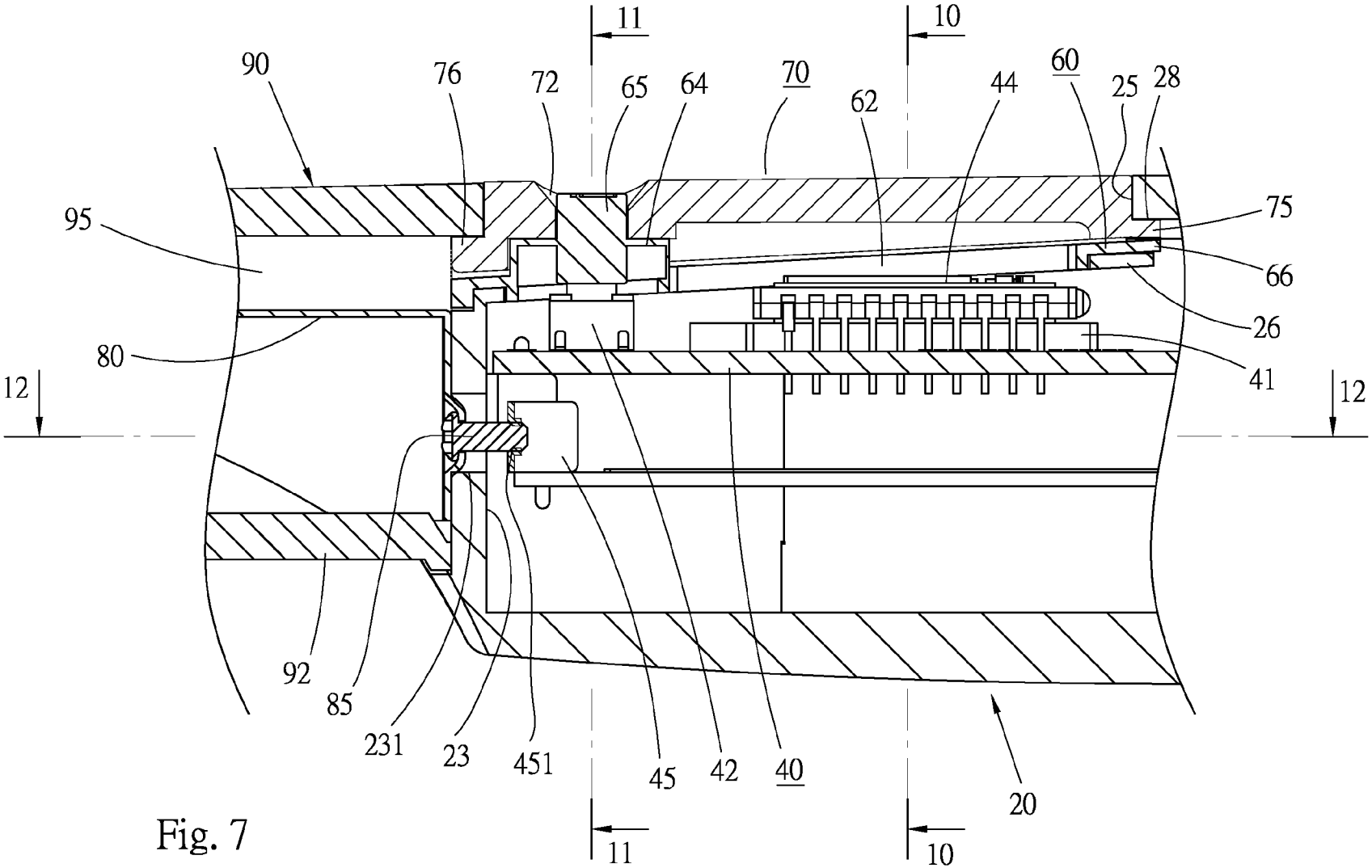
FIG. 7 is an enlarged view of a part of FIG. 6.
Figure 8:
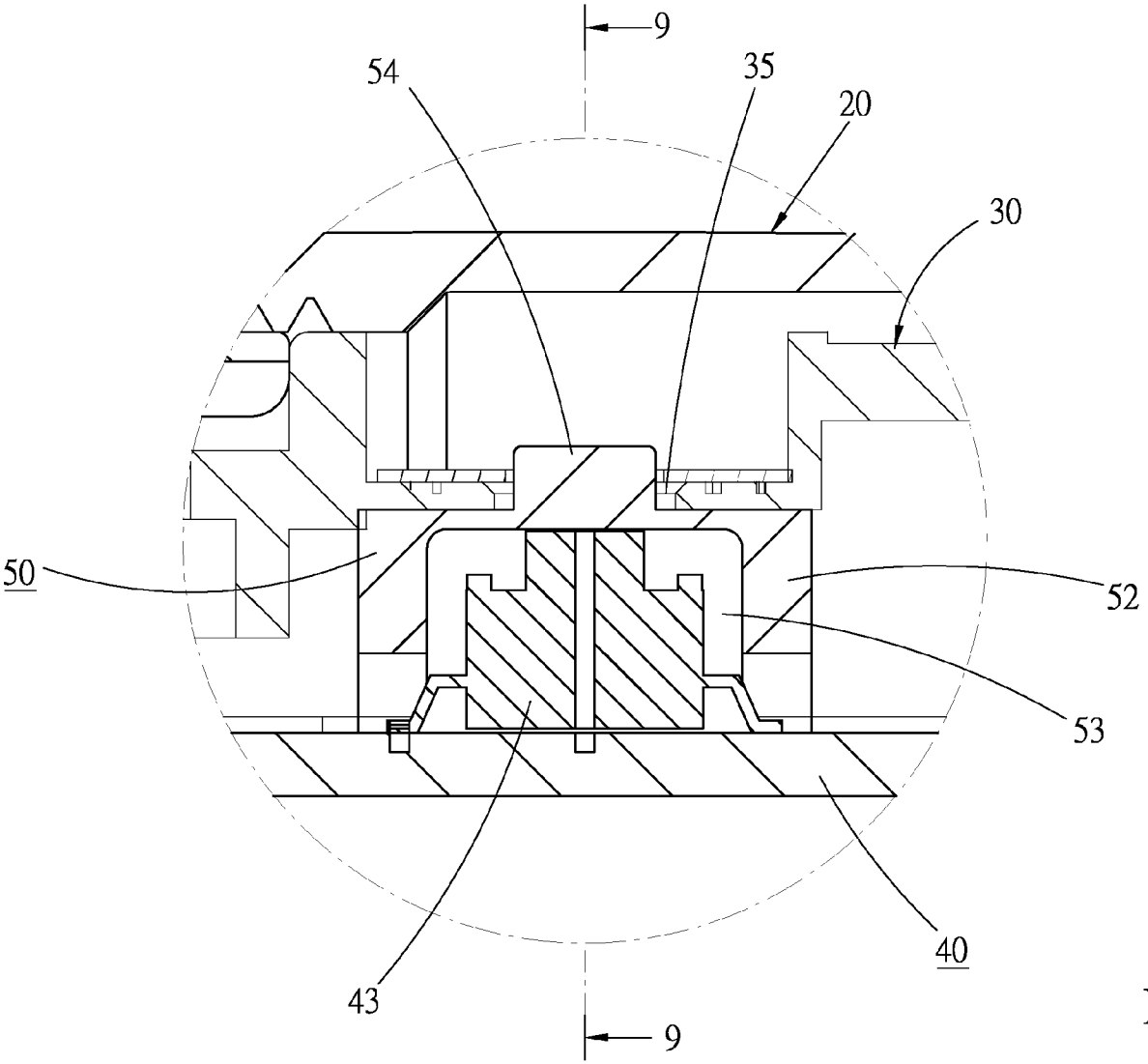
FIG. 8 is an enlarged view of another part of FIG. 6.
Figure 9:
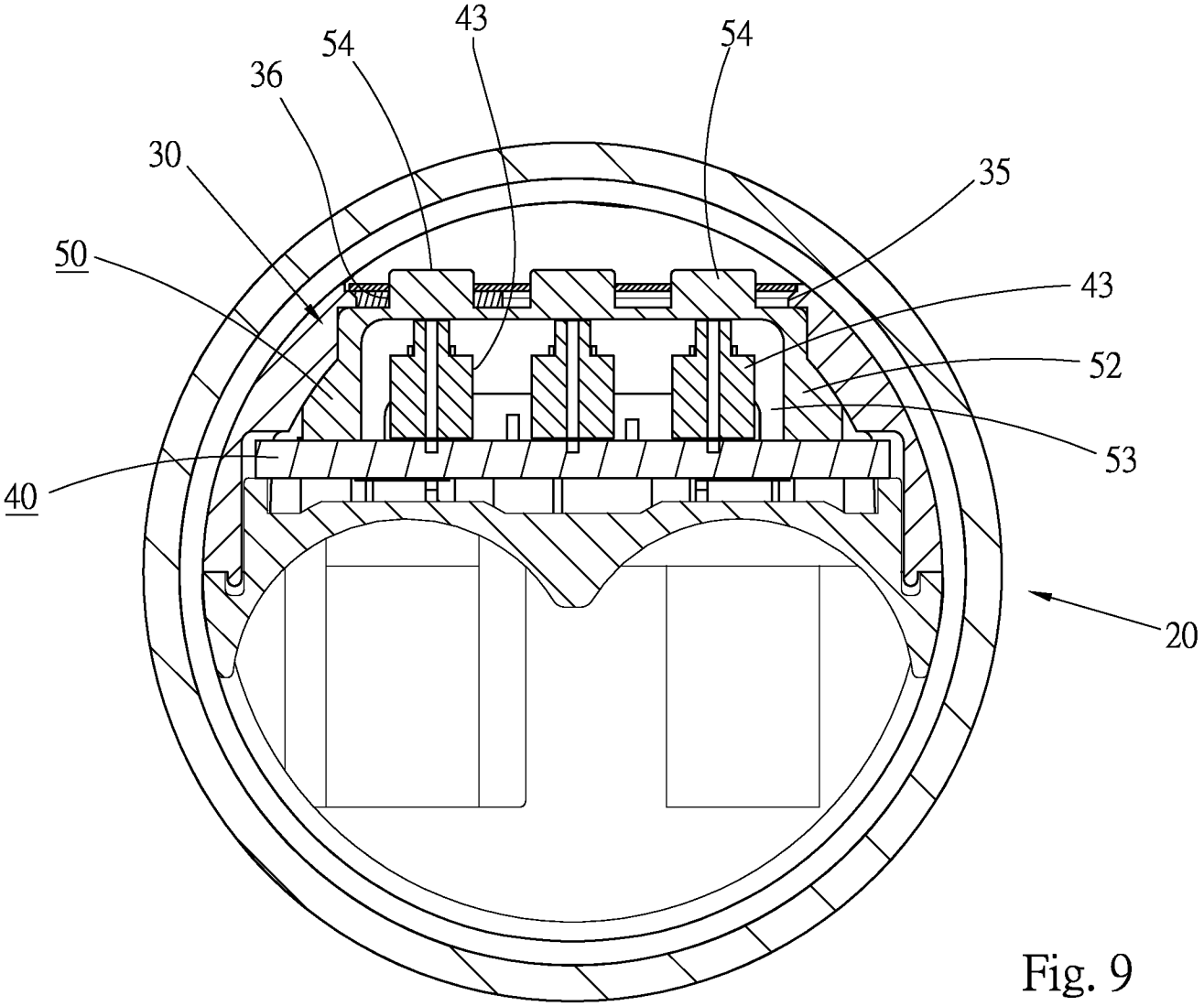
FIG. 9 is a sectional view taken along line 9-9 of FIG. 8.

The circuit board 40 is mounted in the support 30 and located in the handle 20. The liquid crystal display screen 44 and the on-off switch 42 are aligned with the window 25 of the handle as shown in FIGS. 6 and 7. The flange section 26 defines first hollow section 261 corresponding to the liquid crystal display screen 44 as shown in FIG. 4 and a second hollow section 262 corresponding to the switch 42. The frequency adjustment switches 43 are aligned with the perforations 35, 36 as shown in FIGS. 8 and 9. A first connection member 45 and two second connection members 46 are disposed at rear end of the circuit board 40 and positioned in bottom end of the receiving space of the handle. The first and second connection members 45, 46 are made of electrically conductive material.

A rubber-made soft pushbutton 50 has a main body 52 and at least one raised press section 54 disposed on top face of the main body. In this embodiment, there are three press sections 54. Please refer to FIGS. 8 and 9. The soft pushbutton 50 is sealed on an inner wall face of the support 30. The main body 52 blocks the two perforations 35, 36. The three press sections 54 protrude from the perforations 35, 36. The three frequency adjustment switches 43 are positioned in a recessed space 53 formed on bottom face of the main body 52 of the pushbutton 50 and enclosed by the main body 52 in alignment with the three press sections 54 respectively. Accordingly, the soft pushbutton 50 provides airtight effect for the sections of the support 30, where the two perforations 35, 36 are formed. When pressing the three press sections 54, the three adjustment switches 43 are pressed to adjust the frequency of the microphone.

Figure 10:
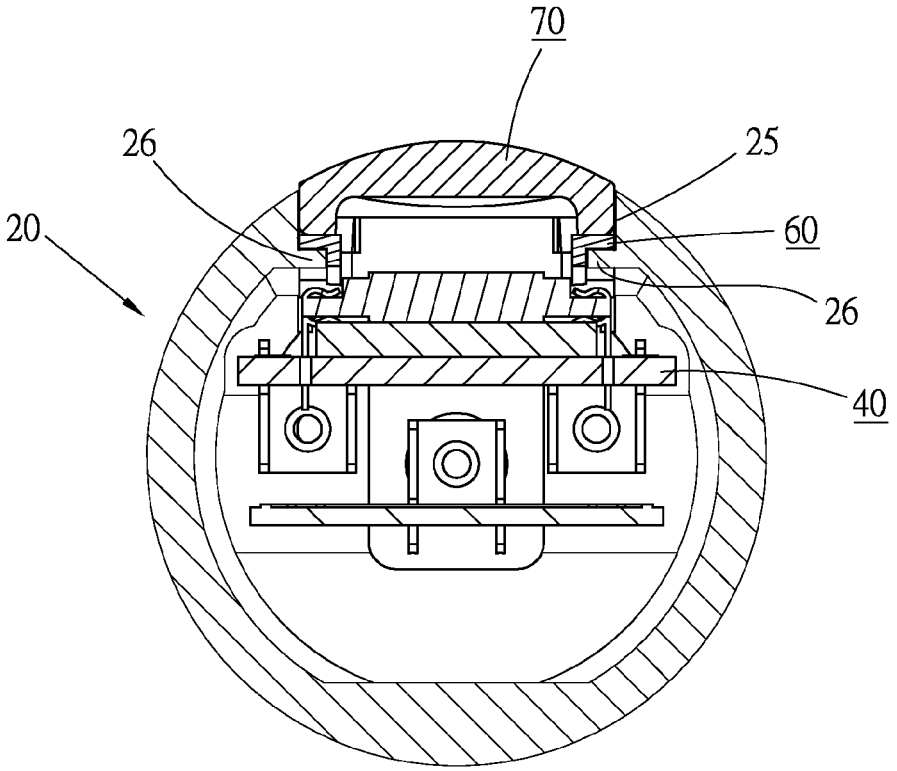
FIG. 10 is a sectional view taken along line 10-10 of FIG. 7.

Please refer to FIG. 4. A rubber-made sealing member 60 is an elongated leakproof member having a configuration corresponding to that of the flange section 26. The sealing member 60 has a rectangular hollow section 62 and a slightly raised platform 64. A raised button 65 is disposed on the platform. A tongue section 66 is disposed at front end of the sealing member 60. The sealing member 60 is disposed at the window 25. A periphery of the sealing member 60 is snugly attached to the flange section 26. As shown in FIGS. 7 and 10, the tongue section 66 extends into the engagement section 28 of the window. The hollow section 62 is positioned at the first hollow section 261 in alignment with the display screen 44. The platform 64 is positioned at the second hollow section 262 in alignment with the on-off switch 42. Bottom end of the raised button 65 is in contact with the on-off switch 42. Therefore, by means of pressing the raised button 65, the switch 42 can be activated. In this embodiment, a waterproof adhesive material (such as silicone) is further applied between the sealing member 60 and the peripheral wall of the window 25, (including the flange section 26), so as to enhance the sealing ability between the sealing member and the window.

Figure 11:
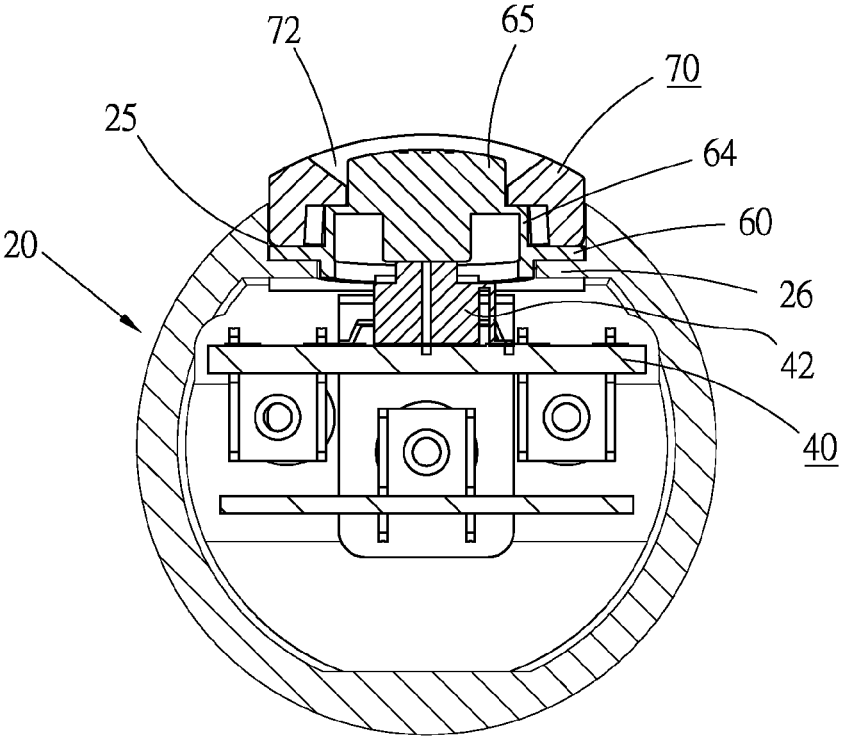
FIG. 11 is a sectional view taken along line 11-11 of FIG. 7.

As shown in FIG. 4, a plastic-made cover board 70 has transparency. The body of the cover board 70 is formed with a buttonhole 72 and lens section 74. The lens section 74 has a curvature different from that of any other part of the cover board to serve as a magnifier. A latch section 75 is disposed on an edge of the cover board 70. An abutment section 76 is disposed at rear end of the cover board. The cover board 70 is disposed at the window 25 of the handle 20 as shown in FIGS. 7 and 11. The bottom face of the cover board 70 is contact with the sealing member 60. The lens section 74 is positioned above the hollow section 62 of the sealing member 60, whereby the information on the display screen 44 can be seen through the lens section 74 as shown in FIG. 1. The lens section can magnify the numerals, symbols or pictures on the display screen to facilitate reading. The platform 64 of the sealing member 60 is in contact with the bottom face of the cover board 70 around the buttonhole 72. The raised button 65 protrudes from the buttonhole 72 for a user to press. Preferably, no gap exists between the raised button and the buttonhole. The latch section 75 of the cover board 70 extends into the engagement section 28 of the window 25 to press the tongue section 66 of the sealing member 60. The abutment section 76 is positioned at rear end of the window 25.

The antenna 80 is an elongated plate body made of metal material. A connection member 85, which is a screw, is passed through a through hole 82 formed on a front wall of the antenna 80 and passed through the hole 231 of the bottom wall 23 of the handle 20 as shown in FIG. 7 and screwed in a threaded hole 451 of the first connection member 45 of the circuit board 40. Accordingly, the antenna 80 is fixedly disposed in the cavity 24 of the rear end of the handle 20 with its rear end rearward protruding. The antenna is electrically connected to the circuit board 40 via the connection member 85 for transmitting radio signals. It should be noted that the hole 231 of the bottom wall can be a threaded hole and the connection member 85 is screwed in the threaded hole 231 to fix the antenna 80. One end of the connection member 85 extends into the receiving space of the handle to contact the first connection member 45.

Figure 12:
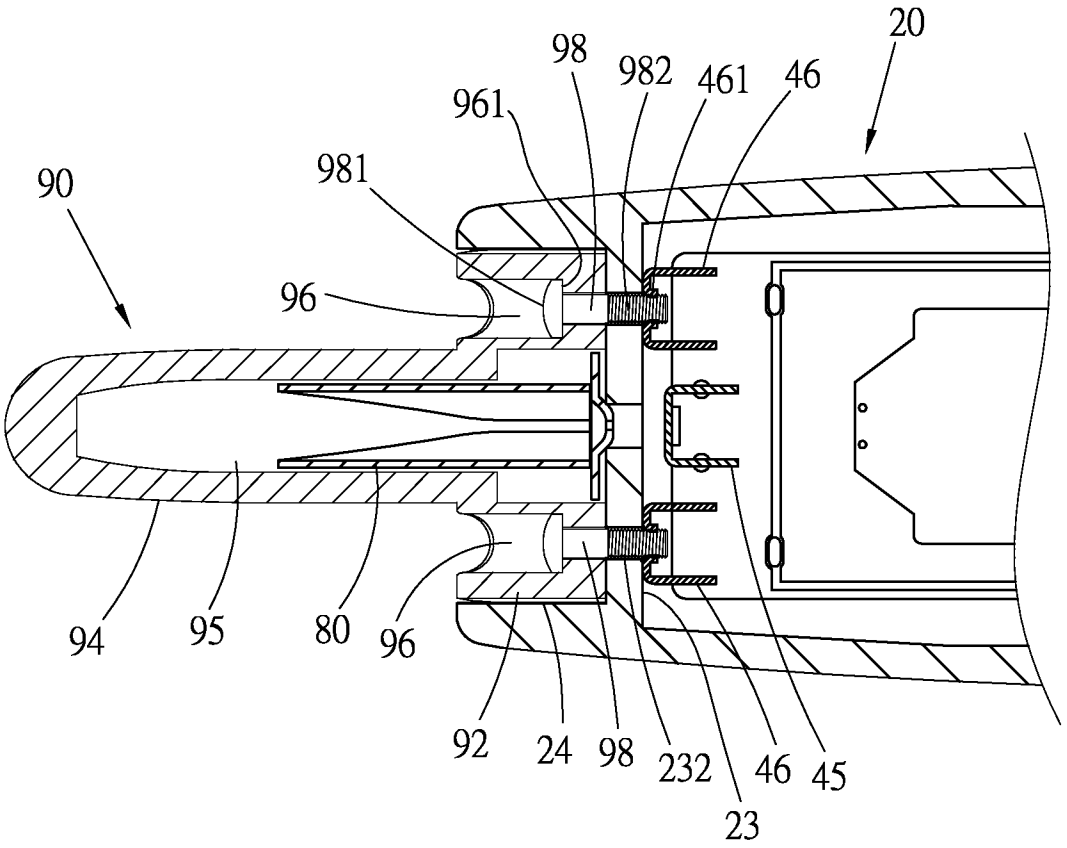
FIG. 12 is a sectional view taken along line 12-12 of FIG. 7.

The identification member 90 is made of polymer material such as rubber or plastic and has a certain hardness and flexibility. The identification member 90 has a main body 92 and a body section 94 rearward extending from the main body 92. The body section 94 has a width smaller than the width of the main body. A front end of the identification member 90 is inward recessed to form a chamber 95 extending into the body section 94. Two stepped connection holes 96 are formed on two sides of the main body 92 as shown in FIG. 12. The main body 92 of the identification member 90 is sealedly mounted in the cavity 24 of the rear end of the handle 20. The antenna 80 is received in the chamber 95 of the identification member 90 and enclosed by the identification member 90 without being exposed to outer side.

Two assembling members 98, which are screws, are respectively passed through the two connection holes 96 of the identification member 90. The head sections 981 of the assembling members 98 abut against shoulder sections 961 of the connection holes, while the stem sections 982 of the assembling members 98 are passed through two holes 232 of the bottom wall 23 of the handle and screwed into the threaded holes 461 of the second connection members 46 of the circuit board 40. The two assembling members 98 serve to press and tighten the identification member 90 and thus expand the identification member 90 to be fully sealedly received in the cavity 24 with an airtight effect. Moreover, as shown in FIG. 7, the front end of the identification member 90 is mounted in the notch 241 of the cavity 24 to press the abutment section 76 of the rear end of the cover board 70. Accordingly, the latch section 75 of the front end of the cover board 70 and the abutment section 76 of the rear end of the cover board 70 are pressed and restricted, whereby the cover board presses the sealing member 60 and makes the sealing member 60 truly sealedly attached to the flange section 26 of the window 25.

It should be noted that the two holes 232 can be threaded holes and the two assembling members 98 are screwed in the two holes 232 to fix the identification member 90. In this embodiment, the two assembling members 98 are electrically connected to the circuit device of the circuit board via the two connection members 46 to serve as the charging terminals of the microphone.

A coiled pickup head 100 is mounted at the front end of the support 30 for receiving sound. The pickup head 100 is connected to the circuit board 40 for transmitting signals. The pickup head pertains to prior art and thus will not be further described hereinafter.

A screen head 105 is screwed on the front end of the handle 20 for protecting the pickup head 100. A sponge is mounted in the screen head 105 to filter noise and provide waterproof effect.

Figure 13:
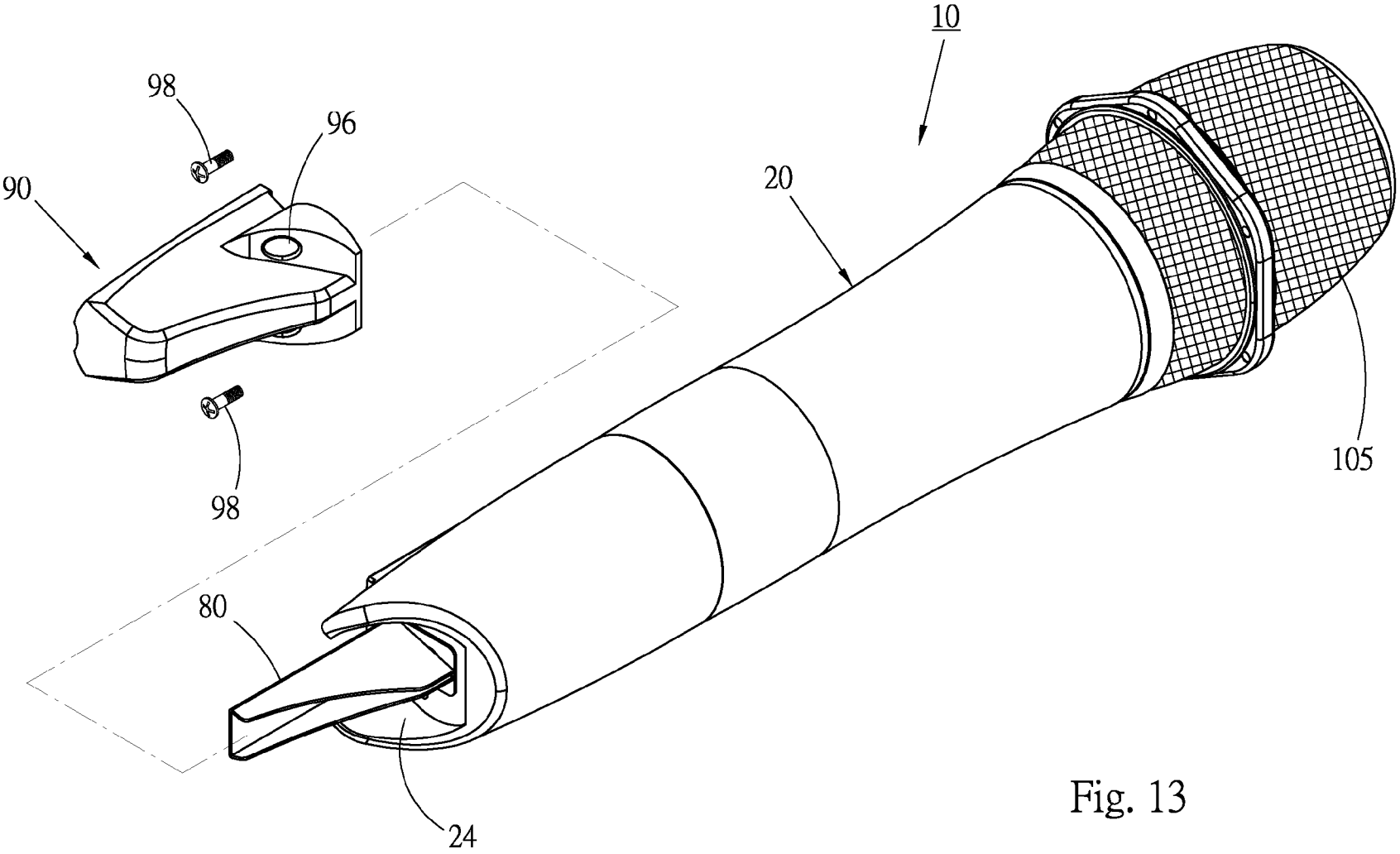
FIG. 13 is a perspective view of the preferred embodiment of the microphone of the present invention, in which the identification member is separated from the microphone.

In the present invention, the identification member 90 not only serves as a sealing member at the bottom end of the microphone, but also serves as an identification member of the microphone. The microphone can be used with different colors of identification members 90. When it is desired to change the identification color of the microphone, a user only needs to unscrew the two assembling members 98 to remove the identification member 90 as shown in FIG. 13. Then the user can replace the identification member 90 with another identification member with a different color. Therefore, the identification color of the microphone can be easily changed for easy identification. In addition, the identification member is unlikely to be shaded.

In the microphone of the present invention, the switches and the display screen of the circumference of the handle have very good airtight effect by means of the collocation between the window, the sealing member and the cover board. The bottom end of the handle is provided with airtight effect by means of the design of the identification member. The frequency adjustment switch of the microphone is protected by the assembling structure of the soft pushbutton. Therefore, the microphone has full and better waterproof effect. The microphone of the present invention is 3 atm waterproof and can be used in common state with a waterproof effect, i.e. it is waterproof in daily activities.

Furthermore, the identification member is easy to install/uninstall to conveniently replace the identification color of the microphone.

The above embodiments are only used to illustrate the present invention, not intended to limit the scope thereof. Many modifications of the above embodiments can be made without departing from the spirit of the present invention.

What is claimed is:

1. A microphone waterproof structure comprising:

a handle, which is a hollow tubular body having an internal receiving space, a window being formed on a top face of the handle;

a circuit board having at least one pushbutton and a display screen, the circuit board being mounted in the handle with the pushbutton and the display screen aligned with the window;

a sealing member made of soft material, the sealing member being formed with a hollow section and a raised button, the sealing member being disposed at the window with the hollow section aligned with the display screen and the raised button aligned with the pushbutton, whereby when the raised button is pressed, the pushbutton is activated;

a transparent cover board, a buttonhole being formed on a body section of the cover board, the cover board being disposed at the window of the handle in contact with the sealing member to make a periphery of the sealing member seal the window, the raised button of the sealing member protruding from the buttonhole; and a pickup head positioned at a front end of the handle and electrically connected to the circuit board.

2. The microphone waterproof structure as claimed in claim 1, wherein a rectangular inward extending flange section is formed along a periphery of the window, the flange section being lower than a top edge of the window; the periphery of the sealing member being snugly attached to the flange section; the cover board being positioned on the sealing member.

3. The microphone waterproof structure as claimed in claim 2, further comprising an identification member disposed at a rear end of the handle; a front end of the cover board being restricted by at least one wall face of the window; a rear end of the cover board being restricted by the identification member.

4. The microphone waterproof structure as claimed in claim 2, wherein:

the rear end of the handle is formed with a cavity; the microphone waterproof structure further comprising:

an antenna disposed in the cavity of the handle and electrically connected to the circuit board; and an identification member made of flexible material; a front end of the identification member being inward recessed to form a chamber; the identification member being connected with the rear end of the handle and sealedly disposed in the cavity; the antenna being received in the chamber of the identification member.

5. The microphone waterproof structure as claimed in claim 1, wherein a waterproof adhesive material is applied between the sealing member and the periphery of the window.

6. The microphone waterproof structure as claimed in claim 1, wherein the sealing member is further formed with a platform; the raised button being disposed on the platform; the platform being in contact with a bottom face of the cover board.

7. The microphone waterproof structure as claimed in claim 6, further comprising an identification member disposed at a rear end of the handle; a front end of the cover board being restricted by at least one wall face of the window; a rear end of the cover board being restricted by the identification member.

8. The microphone waterproof structure as claimed in claim 6, wherein:

the rear end of the handle is formed with a cavity; the microphone waterproof structure further comprising:

an antenna disposed in the cavity of the handle and electrically connected to the circuit board; and an identification member made of flexible material; a front end of the identification member being inward recessed to form a chamber; the identification member being connected with the rear end of the handle and sealedly disposed in the cavity; the antenna being received in the chamber of the identification member.

9. The microphone waterproof structure as claimed in claim 1, wherein the circuit board further has at least one frequency adjustment switch; the microphone waterproof structure further comprising a support and a soft pushbutton; at least one perforation being formed on a circumference of the support; the support being mounted in the handle, the circuit board being mounted in the support with the frequency adjustment switch aligned with the perforation; the soft pushbutton being made of flexible material, the soft pushbutton having a main body and at least one raised press section disposed on a top face of the main body, the soft pushbutton being disposed on an inner wall face of the support with the main body blocking the perforation; the press section protruding from the perforation, the frequency adjustment switch being aligned with the press section.

10. The microphone waterproof structure as claimed in claim 9, further comprising an identification member disposed at a rear end of the handle; a front end of the cover board being restricted by at least one wall face of the window; a rear end of the cover board being restricted by the identification member.

11. The microphone waterproof structure as claimed in claim 9, wherein:

the rear end of the handle is formed with a cavity; the microphone waterproof structure further comprising:

an antenna disposed in the cavity of the handle and electrically connected to the circuit board; and an identification member made of flexible material; a front end of the identification member being inward recessed to form a chamber; the identification member being connected with the rear end of the handle and sealedly disposed in the cavity; the antenna being received in the chamber of the identification member.

12. The microphone waterproof structure as claimed in claim 11, wherein the identification member is detachably connected to the handle by means of at least one assembling member.

13. The microphone waterproof structure as claimed in claim 1, further comprising an identification member disposed at a rear end of the handle; a front end of the cover board being restricted by at least one wall face of the window; a rear end of the cover board being restricted by the identification member.

14. The microphone waterproof structure as claimed in claim 1, wherein:

the rear end of the handle is formed with a cavity; the microphone waterproof structure further comprising:

an antenna disposed in the cavity of the handle and electrically connected to the circuit board; and an identification member made of flexible material; a front end of the identification member being inward recessed to form a chamber; the identification member being connected with the rear end of the handle and sealedly disposed in the cavity; the antenna being received in the chamber of the identification member.

15. The microphone waterproof structure as claimed in claim 14, wherein the rear end of the window of the handle communicates with the cavity; the front end of the identification member restricting the rear end of the cover board from a communication section between the window and the cavity.

16. The microphone waterproof structure as claimed in claim 14, wherein the identification member is detachably connected to the handle by means of at least one assembling member.

17. The microphone waterproof structure as claimed in claim 16, wherein the identification member has a main body and a body section rearward extending from the main body; at least two assembling members, which are threaded members, being disposed on two sides of the main body to fix a front end of the main body in the cavity of the handle.

18. The microphone waterproof structure as claimed in claim 14, wherein an engagement section is disposed on a wall face of the window; a top wall of the cavity being formed with a notch in communication with the rear end of the window; a latch section being disposed on an edge of the cover board, the latch section being engaged with the engagement section of the window; the front end of the identification member pressing the rear end of the cover board from the notch of the cavity.

19. The microphone waterproof structure as claimed in claim 14, wherein:

the circuit board further has a first connection member and at least one second connection member, the first and second connection members being electrically connected to the circuit of the circuit board;

an electrically conductive connection member, one end of connection member being connected to the antenna, the other end of the connection member extending into the handle to connect with or contact the first connection member; and at least one electrically conductive assembling member, the identification member being detachably connected to the rear end of the handle by means of the assembling member, one end of the assembling member extending into the handle to connect with or contact the second connection member.

* * * * *